US009593585B2

(12) United States Patent
Green et al.

(10) Patent No.: US 9,593,585 B2
(45) Date of Patent: Mar. 14, 2017

(54) SEAL ASSEMBLY FOR A GAP BETWEEN OUTLET PORTIONS OF ADJACENT TRANSITION DUCTS IN A GAS TURBINE ENGINE

(71) Applicants: Andrew G. Green, Jupiter, FL (US); Miguel Bascones, Oviedo, FL (US)

(72) Inventors: Andrew G. Green, Jupiter, FL (US); Miguel Bascones, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 821 days.

(21) Appl. No.: 14/053,628

(22) Filed: Oct. 15, 2013

(65) Prior Publication Data

US 2015/0101345 A1 Apr. 16, 2015

(51) Int. Cl.
*F01D 9/02* (2006.01)

(52) U.S. Cl.
CPC ..... *F01D 9/023* (2013.01); *F01D 9/02* (2013.01)

(58) Field of Classification Search
CPC ..... F16J 15/3288; F16J 15/3284; F16J 15/12; F16J 15/128; F01D 9/023; F01D 9/02; F01D 9/00; F01D 9/047; F01D 11/003
See application file for complete search history.

(56) References Cited

U.S. PATENT DOCUMENTS

| | | | | |
|---|---|---|---|---|
| 4,477,086 | A | 10/1984 | Feder et al. | |
| 5,125,796 | A | 6/1992 | Cromer | |
| 5,400,586 | A * | 3/1995 | Bagepalli | F01D 9/023 277/355 |
| 6,237,921 | B1 | 5/2001 | Liotta et al. | |
| 6,659,472 | B2 | 12/2003 | Aksit et al. | |
| 7,784,264 | B2 * | 8/2010 | Weaver | F01D 9/023 60/39.37 |
| 7,870,738 | B2 | 1/2011 | Zborovsky et al. | |
| 8,225,614 | B2 | 7/2012 | Lacy et al. | |
| 2011/0049812 | A1 | 3/2011 | Sutcu | |
| 2011/0140370 | A1 | 6/2011 | Sutcu | |
| 2012/0200046 | A1 * | 8/2012 | Green | F01D 9/023 277/647 |
| 2012/0292861 | A1 | 11/2012 | Moehrle et al. | |

FOREIGN PATENT DOCUMENTS

| | | | |
|---|---|---|---|
| EP | 1865262 | A1 | 12/2007 |
| EP | 1903184 | A2 | 3/2008 |
| EP | 2395201 | A2 | 12/2011 |
| EP | 2520765 | A2 | 11/2012 |
| EP | 2626600 | A2 | 8/2013 |
| WO | 2010027384 | A1 | 3/2010 |

* cited by examiner

*Primary Examiner* — David Bryant
*Assistant Examiner* — Lawrence Averick

(57) ABSTRACT

A seal assembly for sealing a circumferential leakage gap between outlet portions of first and second adjacent transition ducts in a gas turbine engine includes a first seal member affixed to the outlet portion of the first transition duct and a second seal member movable with respect to the first seal member. The second seal member is positionable in a non-sealing first position and a sealing second position. While in the first position, the second seal member is circumferentially spaced from the outlet portion of the second transition duct. While in the second position, the second seal member extends across the leakage gap and creates a seal with the outlet portion of the second transition duct to substantially prevent leakage through the leakage gap.

20 Claims, 4 Drawing Sheets

FIG. 4
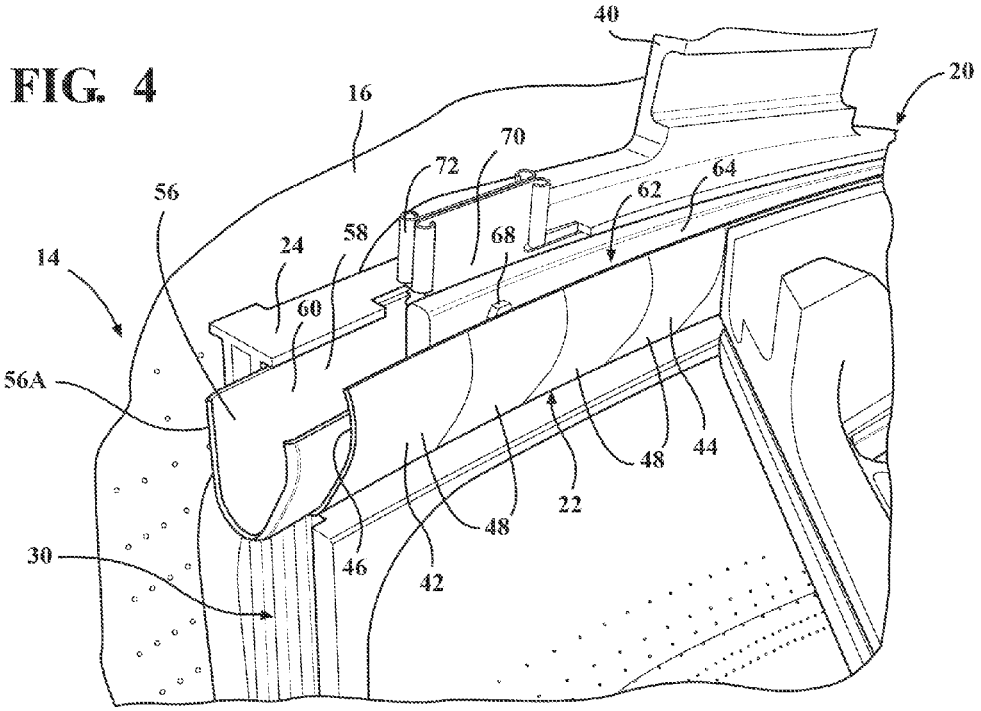
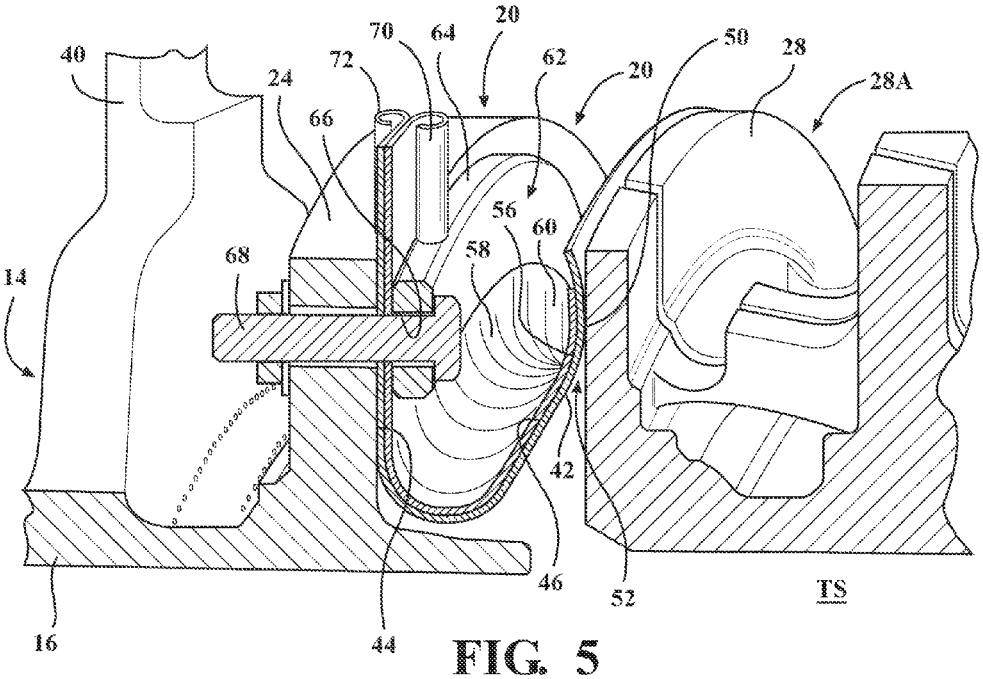
FIG. 5

SEAL ASSEMBLY FOR A GAP BETWEEN OUTLET PORTIONS OF ADJACENT TRANSITION DUCTS IN A GAS TURBINE ENGINE

FIELD OF THE INVENTION

The present invention relates generally to a seal assembly for a gap between outlet portions of adjacent transition ducts in a gas turbine engine, and, more particularly, to a seal assembly that includes a seal member that is movable between an open position useful during installation to a closed position wherein the seal assembly prevents or reduces fluid leakage through the gap during operation of the engine.

BACKGROUND OF THE INVENTION

A conventional combustible gas turbine engine includes a compressor section, a combustion section including a plurality of combustors, and a turbine section. Ambient air is compressed in the compressor section and conveyed to the combustors in the combustion section. The combustors introduce fuel into the compressed air and ignite the mixture creating combustion products defining hot working gases that flow in a turbulent manner and at a high velocity. The working gases are routed to the turbine section via a plurality of transition ducts. Within the turbine section are rows of stationary vane assemblies and rotating blade assemblies. The rotating blade assemblies are coupled to a turbine rotor. As the working gases expand through the turbine section, the working gases cause the blades assemblies, and therefore the turbine rotor, to rotate. The turbine rotor may be linked to an electric generator, wherein the rotation of the turbine rotor can be used to produce electricity in the generator.

The transition ducts in a can annular combustion section are positioned adjacent to one another and are typically sealed together in some manner to prevent leakage through gaps that extend between respective duct outlet portions. The transition duct outlet portions may also be sealed to structure at the inlet of the turbine section to prevent leakage between the transition ducts and the turbine section structure.

SUMMARY OF THE INVENTION

In accordance with one aspect of the present invention, a seal assembly is provided for sealing a circumferential leakage gap between outlet portions of first and second adjacent transition ducts in a gas turbine engine. The seal assembly comprises a first seal member affixed to the outlet portion of the first transition duct and a second seal member associated with the first seal member and movable with respect to the first seal member. The second seal member is positionable in at least a non-sealing first position with respect to the outlet portion of the second transition duct and a sealing second position with respect to the outlet portion of the second transition duct. While in the first position, the second seal member is circumferentially spaced from the outlet portion of the second transition duct. While in the second position, the second seal member extends across the leakage gap between the first and second transition ducts and creates a seal with the outlet portion of the second transition duct to substantially prevent leakage through the leakage gap.

In accordance with a second aspect of the present invention, a seal assembly is provided for sealing a circumferential leakage gap between outlet portions of first and second adjacent transition ducts in a gas turbine engine. The seal assembly comprises a first seal member affixed to the outlet portion of the first transition duct and defining a circumferentially extending channel, and a second seal member that is movably received in the channel of the first seal member such that the first and second seal members are nested together. The second seal member is positionable in at least a non-sealing first position with respect to the outlet portion of the second transition duct, a sealing second position with respect to the outlet portion of the second transition duct, and at least one intermediate position between the first and second positions. While in the first position, the second seal member is circumferentially spaced from the outlet portion of the second transition duct. While in the second position, the second seal member extends across the leakage gap between the first and second transition ducts and creates a seal with the outlet portion of the second transition duct to substantially prevent leakage through the leakage gap. And while in the at least one intermediate position, the second seal member extend across a portion of the leakage gap between the first and second transition ducts.

In accordance with a third aspect of the present invention, a seal system is provided in a gas turbine engine including an annular array of transition ducts that provide hot working gases from a combustion section to a turbine section of the engine, the transition ducts including outlet portions. The seal system comprises a corresponding seal assembly associated with each respective transition duct outlet portion, wherein each seal assembly comprises a first seal member affixed to the outlet portion of the respective transition duct, and a second seal member associated with the first seal member and movable with respect to the first seal member. The second seal member is positionable in at least a non-sealing first position with respect to the outlet portion of an adjacent transition duct and a sealing second position with respect to the outlet portion of the adjacent transition duct. While in the first position, the second seal member of each seal assembly is circumferentially spaced from the outlet portion of the adjacent transition duct, and while in the second position, the second seal member of each seal assembly extends across a circumferential leakage gap between adjacent transition duct outlet portions and creates a seal with the outlet portion of the adjacent transition duct to substantially prevent leakage through the leakage gap.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 4 is an enlarged perspective view of one of the seal assemblies of FIG. 1, wherein an adjacent transition duct has been removed for clarity; and FIG. 5 is a side cross sectional view of a portion of one of the seal assemblies of FIG. 1 and also illustrating component of a turbine section of the engine that creates a seal with the seal assembly portion.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
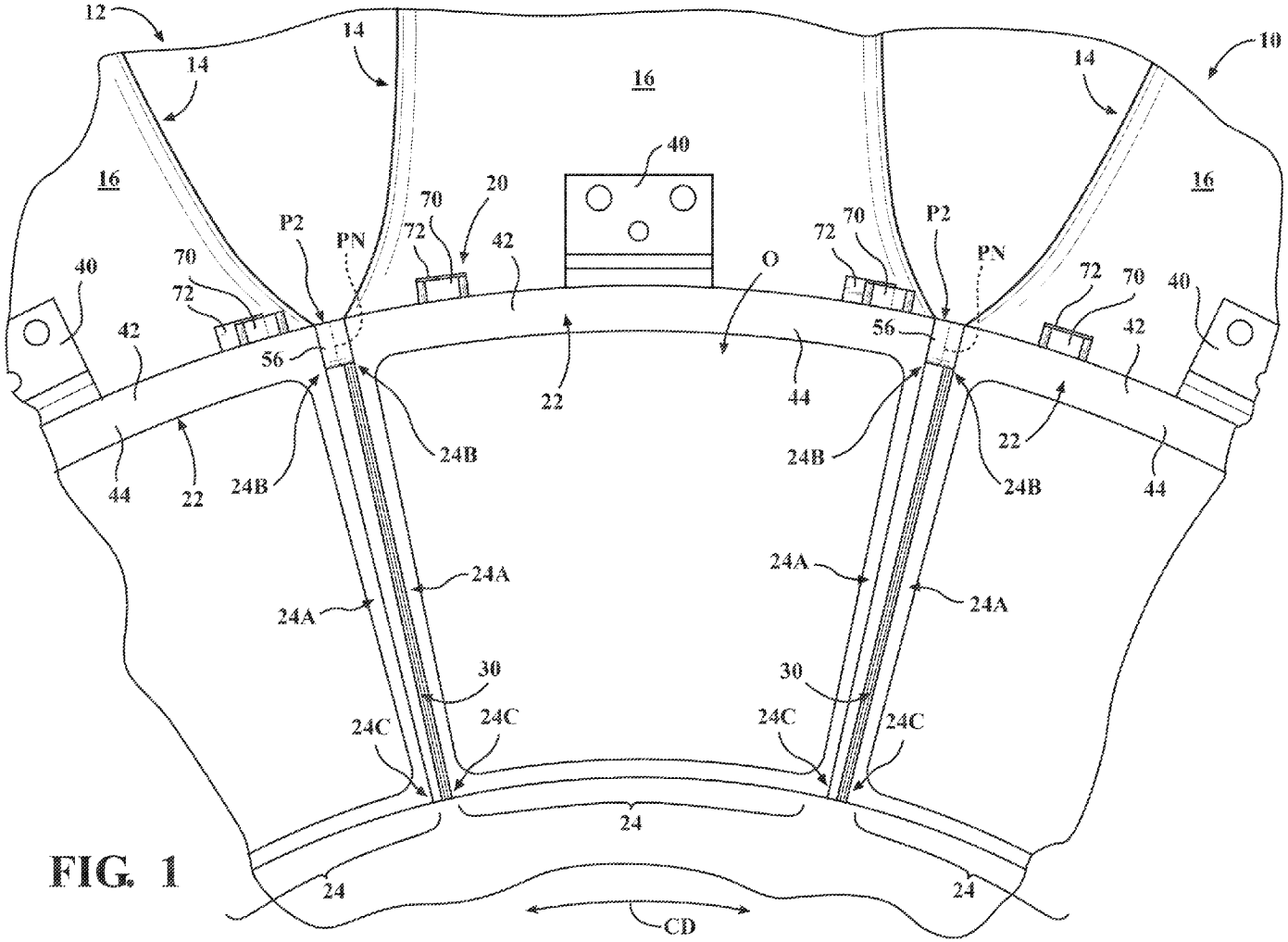
FIG. 1 is a fragmentary elevational view looking in an axial direction toward an assembly including outlet portions of a plurality of transition ducts including seal assemblies according to an aspect of the present invention.

Referring to FIG. 1, an outlet portion 10 of a gas turbine engine combustion section 12 is illustrated. As will be appreciated by those having ordinary skill in the art, can annular combustion sections of gas turbine engines like the one shown in FIG. 1 include a plurality of combustor apparatuses 14, also referred to herein as combustors, which burn mixtures of fuel and air to create hot working gases. The hot working gases are conveyed through respective transition ducts 16 of the combustor apparatuses 14 to a turbine section TS (see FIG. 5) of the engine where the hot working gases are used to rotate a rotor (not shown) in a known manner. While portions of three transition ducts 16 are shown in FIG. 1, it is understood that an annular array of such transition ducts 16 are provided at the outlet portion 10 of the illustrated combustion section 12.

A seal system 20 formed in accordance with the present invention is illustrated in FIG. 1. The seal system 20 comprises a plurality of seal assemblies 22, i.e., one seal assembly 22 per transition duct 16. The seal assemblies 22 are used to seal outer leakage gaps LG (see FIGS. 2A and 3A) that extend in a circumferential direction CD (See FIG. 1) between outlet portions 24, also known as transition exit flanges, of adjacent transition ducts 16 as will be described herein. Specifically, the seal assemblies 22 limit leakages of fluids, .e.g., the hot working gases and/or cooling fluid that is provided to cool structure within the engine, through the leakage gaps LG during operation of the engine. The seal assemblies 22 also limit leakages of such fluids between the transition duct outlet portions 24 and inlet structure 28 defining an inlet portion 28A of the turbine section TS, see FIG. 5.

As shown in FIG. 1, the outlet portions 24 of the transition ducts 16 have a generally rectangular cross section. Intermediate side portions 24A of the adjacent transition duct outlet portions 24 are sealed via labyrinth or zipper style seals 30, which are of a known construction. Outer side portions 24B of the adjacent transition duct outlet portions 24, which are associated with the outer leakage gaps LG, are sealed by the seal assemblies 22 of the seal system 20 as will be described herein. It is noted that corresponding leakage gaps between the inner side portions 24C of the adjacent transition duct outlet portions 24 may be sealed by similar seal assemblies (not shown) to the seal assemblies 22 described herein. Hence, the seal assemblies 22 described herein are not meant to be limited to sealing the leakage gaps LG between the outer side portions 24B of the adjacent transition duct outlet portions 24, as the seal assemblies 22 described herein could also be used to seal the leakage gaps between the inner side portions 24C of the adjacent transition duct outlet portions 24.

One of the seal assemblies 22 associated with one of the transition ducts 16 will now be described. It is noted that the transition ducts 16 of the combustion section 12 and their associated seal assemblies 22 are substantially similar to the one described herein.

The transition duct 16 in the embodiment shown comprises the generally rectangular outlet portion 24, which is coupled, via bracket structure 40, to structure (not shown) affixed to a compressor exit casing (not shown). The outlet portion 24 defines a flow path for the hot working gases passing from the associated combustor apparatus 14 into the turbine section TS. The outlet portion 24 extends about an opening O, which defines an exit of the transition duct 16, see FIG. 1.

As shown most clearly in FIG. 5, a first seal member 42 of the seal assembly 22 is affixed to an axially facing surface 44 of the transition duct outlet portion 24. Any suitable coupling may be used between the first seal member 42 and the surface 44, but in the embodiment shown the coupling is done via bolting as will be described below. While the illustrated first seal member 42 is coupled to the outlet portion 24 by bolting in the embodiment shown, it is noted that the outlet portion 24 and the first seal member 42 could be integrally formed as a single structure without departing from the spirit and scope of the invention.

The first seal member 42 comprises a circumferentially elongate main body portion 44 that defines a circumferentially extending channel 46, see FIGS. 3A, 3B, 4, and 5. The main body 44 may be formed by a single piece that includes a plurality of adjacent panels or tiles 48 separated by corresponding indentations formed in the main body 44 as most clearly shown in FIGS. 2A, 2B, and 4, or the main body 44 may have other suitable configurations, e.g., wherein the main body is formed by a solid, curved member. By providing the main body 44 with panels 48 and corresponding indentations, the flexibility of the first seal member 42 is improved and stresses in the first seal member 42 are reduced as the first seal member 42 is deformed by the adjacent mating components. As shown in FIG. 5, the first seal member 42 includes an aft face 50 that contacts the inlet structure 28 defining the inlet portion 28A of the turbine section TS at a contact interface 52 to substantially prevent leakage between the outlet portion 24 of the transition duct 16 and the turbine section inlet structure 28.

The seal assembly 22 further comprises a second seal member 56 associated with and movable in the circumferential direction CD with respect to the first seal member 42. Specifically, the second seal member 56 is slidably received in the channel 46 of the first seal member 42 such that the first and second seal members 42, 56 are nested together. The second seal member 56 is positionable in at least a non-sealing first position P1 (see FIGS. 2A and 3A) with respect to the outlet portion 24 of the adjacent transition duct 16, i.e., the second seal member 56 is circumferentially spaced from the outlet portion 24 of the adjacent transition duct 16 while in the first position P1 such that the leakage gap LG is unblocked, and a sealing second position P2 (see FIGS. 1, 2B, and 3B) with respect to the outlet portion 24 of the adjacent transition duct 16, i.e., the second seal member 56 extends across at least a portion of the leakage gap LG between the adjacent transition duct outlet portions 24 and creates a seal with the outlet portion 24 of the adjacent transition duct outlet portion 24 to substantially prevent leakage through the leakage gap LG while in the second position P2.

Figure 2A:
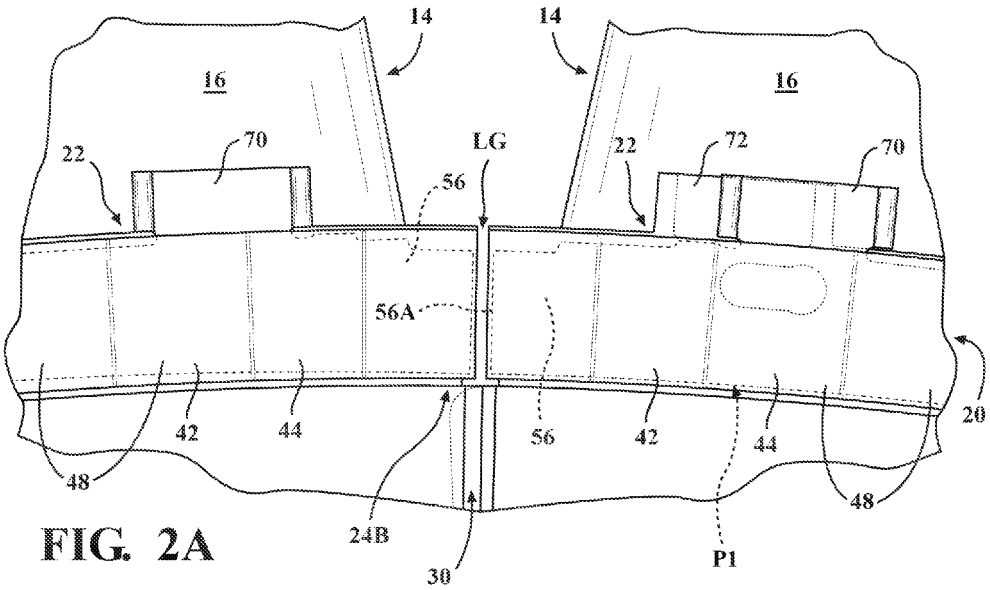
FIG. 2A is fragmentary elevational view of the portion 2A from FIG. 1 and illustrating of one of the seal assemblies of FIG. 1 in an open position.
Figure 3A:
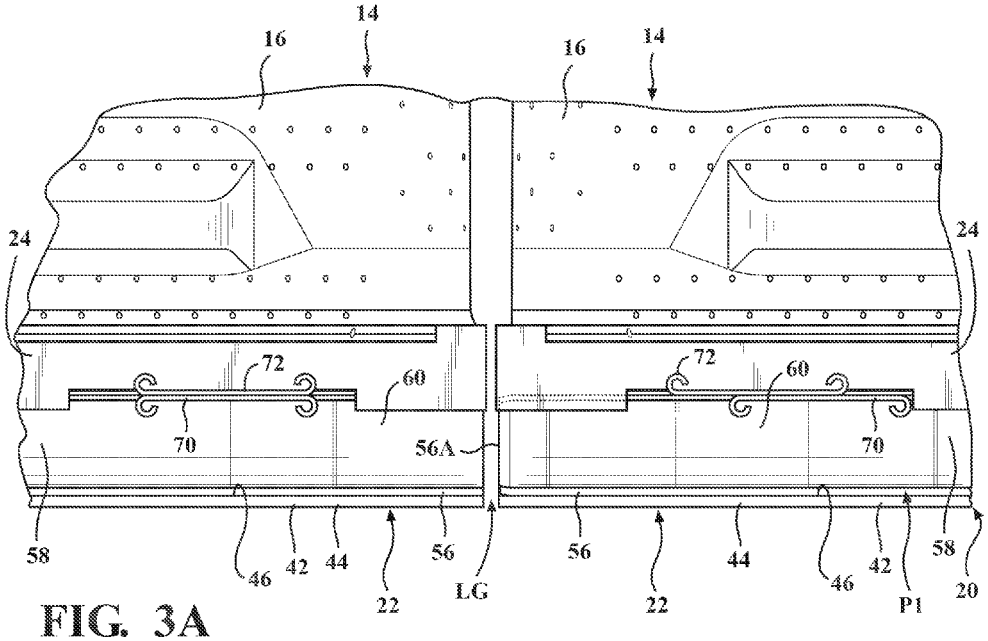
FIG. 3A is a fragmentary elevational view looking in a radially inward direction of one of the seal assemblies illustrated in FIG. 1, wherein the seal assembly is in an open position.

As shown in FIGS. 2A and 3A, while the second seal member 56 is positioned in the first position P1, an entirety of the second seal member 56 may be disposed in the channel 46 of the first seal member 42. Hence, while in the first position P1, the second seal member 56 is entirely concealed and does not interfere with installation or servicing of the transition duct 16.

Figure 2B:
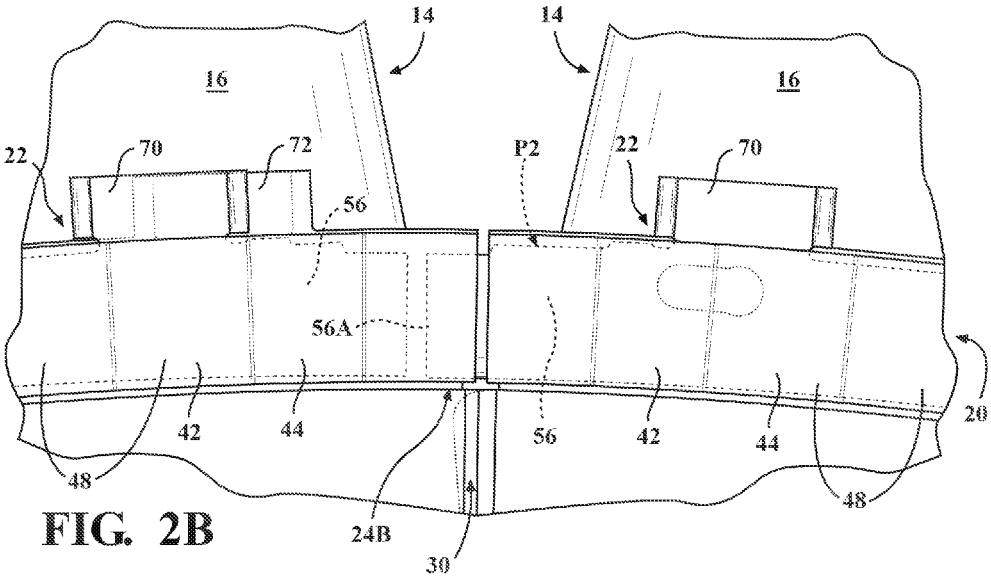
FIG. 2B is view similar to that of FIG. 2A, wherein the seal assembly is in a closed position.
Figure 3B:
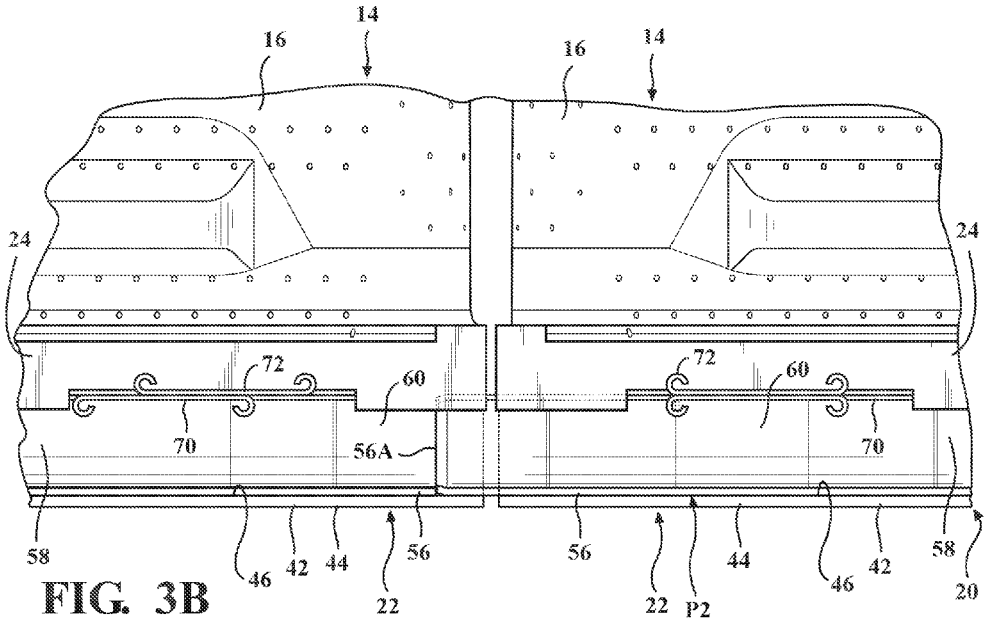
FIG. 3B is view similar to that of FIG. 3A, wherein the seal assembly is in a closed position.

Referring now to FIGS. 2B and 3B, while in the second seal member 56 is positioned in the second position P2, a sealing end portion 56A of the second seal member 56 is located circumferentially outside of the channel 46 of the first seal member 42 and contacts or comes into close proximity to the outlet portion 24 of the adjacent transition duct 16 to seal the leakage gap LG, while a remaining portion 56B of the second seal member 56 is disposed in the channel 46 of the first seal member 42.

It is noted that the second seal member 56 is preferably positionable in at least one intermediate position PN (see dashed line in FIG. 1 depicted the location of the sealing end portion 56A of the second seal member 56) between the first position P1 and the second position P2. A select intermediate position PN may be chosen based on a desired amount of leakage permitted through the leakage gap LG between the outlet portions 24 of the adjacent transition ducts 16, as will be described in more detail herein.

While the second seal member 56 is slidably received in the channel 46 of the first seal member 42 and slides within the channel 46 when moving between positions P1, P2, PN, the second seal member 56 is preferably capable of being secured to the first seal member 42, e.g., by bolting, such that the second seal member 56 can be selectively maintained in a desired position P1, P2, PN. Specifically, similar to the first seal member 42, the second seal member 56 also includes a circumferentially extending main body portion 58 that defines a circumferentially extending channel 60, see FIGS. 3A, 3B, 4, and 5. The channel 60 receives an affixation structure 62 (see FIGS. 4 and 5) comprising an elongate plate 64 that is used to fasten the second seal member 56 to the first seal member 42 so as to retain the second seal member 56 in a desired position P1, P2, PN. The plate 64 comprises a plurality of apertures 66 (see FIG. 5) that receive corresponding bolts 68 that are used to secure the second seal member 56 to the first seal member 42. The bolts 68 in the embodiment shown are also used to secure the first seal member 42 to the transition duct outlet portion 24, although the first seal member 42 could be secured to the transition duct outlet portion 24 in any suitable manner or could be formed integrally with the transition duct outlet portion 24 as noted above.

To facilitate efficient movement of the second seal member 56 between positions P1, P2, PN, the second seal member comprises at least one tab 70 that is adapted to be grasped by an operator and slid in the circumferential direction to move the second seal member 56 between positions P1, P2, PN. The first seal member 42 in the embodiment shown also includes corresponding tab(s) 72 that may be used as anchoring points for the operator's fingers or by a tool (not shown) such as pliers, and also as alignment aid(s) for positioning the second seal member 56 in a desired position P1, P2, PN. For example, in the exemplary configuration shown in FIG. 1, the first and second seal members 42, 56 each include two tabs 70, 72. If the second seal member is to be positioned in the first position P1, the tabs 70, 72 on the right hand side of the middle transition duct 16 shown in FIG. 1 are aligned, and if the second seal member is to be positioned in the second position P2, the tabs 70, 72 on the left hand side of the middle transition duct 16 shown in FIG. 1 are aligned. It is understood that additional configurations for the tabs 70, 72 could be used without departing from the scope and spirit of the invention.

The seal system 20 described herein limits leakage of fluids through the leakage gaps LG between adjacent transition duct outlet portions 24, and also through the contact interface 52 between the first seal members 42 and the turbine section inlet structure 28. Hence, reductions in the temperature of the hot working gases passing out of the respective transition duct outlet potions 24 are minimized or decreased, and cooling fluid used to cool structure in the engine is preserved for that structure to be cooled. However, as noted above, in addition to being positionable in the non-sealing first position P1 and the sealing second position P2, the second seal member 56 is preferably positionable in at least one intermediate position PN between the first and second positions P1, P2. Such intermediate position(s) PN may be useful in situations where some amount of fluid leakage through the leakage gaps GP between adjacent transition duct outlet portions 24 is desirable, i.e., to fine tune performance of the engine.

Additionally, since the seal assemblies 22 of the seal system 20 in the embodiment shown are rigidly affixed to the transition duct outlet portions 24 but not to the turbine section inlet structure 28, forces transferred between the transition duct outlet potions 24/seal assemblies 22 and the turbine section inlet structure 28 via the seal assemblies 22 are believed to be reduced. That is, forces transferred between the transition duct outlet potions 24/seal assemblies 22 and the turbine section inlet structure 28 via the seal assemblies 22 are believed to be generally limited to frictional forces, i.e., caused by the first seal members 42 rubbing against the turbine section inlet structure 28, wherein rigid full-force transmission, i.e., binding forces, between the transition duct outlet potions 24/seal assemblies 22 and the turbine section inlet structure 28, e.g., caused by thermal growth of either or both of the transition duct outlet potions 24/seal assemblies 22 and the turbine section inlet structure 28, are believed to be reduced or avoided. Moreover, even in the case of thermal growth of either or both of the transition duct outlet potions 24/seal assemblies 22 and the turbine section inlet structure 28, the seal assemblies 22 may be capable of effecting a substantially fluid tight seal therebetween, since the first seal members 42 of the seal assemblies 22 may be preloaded against the turbine section inlet structure 28.

Finally, as noted above, the seal assemblies 22 described herein are not meant to be limited to sealing the leakage gaps LG between the outer side portions 24B of the adjacent transition duct outlet portions 24, as the seal assemblies 22 described herein could also be used to seal corresponding leakage gaps between the inner side portions 24C of the adjacent transition duct outlet portions 24. This may be accomplished by reversing the orientation of the seal assemblies 22, i.e., wherein the channels 46, 60 of the first and second seal members 42, 56 would have a concave orientation that faces radially inwardly. An aft face 50 of the first seal member 42 in such an arrangement could contact additional turbine section inlet structure (not shown) to substantially prevent leakage through a corresponding interface therebetween.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly for sealing a circumferential leakage gap between outlet portions of first and second adjacent transition ducts in a gas turbine engine, the seal assembly comprising:

a first seal member affixed to the outlet portion of the first transition duct;

a second seal member associated with the first seal member and movable with respect to the first seal member, the second seal member positionable in at least a non-sealing first position with respect to the outlet portion of the second transition duct and a sealing second position with respect to the outlet portion of the second transition duct;

wherein, while in the first position, the second seal member is circumferentially spaced from the outlet portion of the second transition duct; and wherein, while in the second position, the second seal member extends across the leakage gap between the first and second transition ducts and creates a seal with the outlet portion of the second transition duct to substantially prevent leakage through the leakage gap.

2. The seal assembly of claim 1, wherein the first seal member defines a circumferentially extending channel that receives the second seal member such that the first and second seal members are nested together, wherein the second seal member slides within the channel when moving between the first and second positions.

3. The seal assembly of claim 2, wherein the first seal member includes an aft face that contacts a turbine section inlet structure to substantially prevent leakage between the first transition duct and the turbine section inlet structure.

4. The seal assembly of claim 2, wherein the second seal member comprises at least one tab that is adapted to be grasped by an operator and slid in the circumferential direction to move the second seal member between the first and second positions.

5. The seal assembly of claim 2, wherein the second seal member defines a circumferentially extending channel that receives affixation structure that is used to fasten the second seal member to the first seal member to retain the second seal member in a desired position.

6. The seal assembly of claim 2, wherein, while the second seal member is in the first position, an entirety of the second seal member is disposed in the channel of the first seal member.

7. The seal assembly of claim 6, wherein, while in the second seal member is in the second position, a sealing end portion of the second seal member is located circumferentially outside of the channel of the first seal member and creates a seal with the outlet portion of the second transition duct, while a remaining portion of the second seal member is disposed in the channel of the first seal member.

8. The seal assembly of claim 1, wherein the second seal member is movable to at least one intermediate position between the first position and the second position.

9. The seal assembly of claim 8, wherein the at least one intermediate position is selected based on a desired amount of leakage permitted through the leakage gap between the outlet portions of the first and second transition ducts.

10. A seal assembly for sealing a circumferential leakage gap between outlet portions of first and second adjacent transition ducts in a gas turbine engine, the seal assembly comprising:

a first seal member affixed to the outlet portion of the first transition duct, the first seal member defining a circumferentially extending channel;

a second seal member movably received in the channel of the first seal member such that the first and second seal members are nested together, the second seal member being positionable in at least:

a non-sealing first position with respect to the outlet portion of the second transition duct wherein the second seal member is circumferentially spaced from the outlet portion of the second transition duct;

a sealing second position with respect to the outlet portion of the second transition duct wherein the second seal member extend across the leakage gap between the first and second transition ducts and creates a seal with the outlet portion of the second transition duct to substantially prevent leakage through the leakage gap; and at least one intermediate position between the first and second positions wherein the second seal member extend across a portion of the leakage gap between the first and second transition ducts.

11. The seal assembly of claim 10, wherein the first seal member includes an aft face that contacts a turbine section inlet structure to substantially prevent leakage between the first transition duct and the turbine section inlet structure.

12. The seal assembly of claim 10, further comprising affixation structure to fasten the second seal member so as to retain the second seal member in a selected position.

13. The seal assembly of claim 12, wherein the second seal member defines a circumferentially extending channel that receives the affixation structure, the affixation structure also being used to secure the first seal member to the outlet portion of the first transition duct.

14. The seal assembly of claim 10, wherein, while the second seal member is in the first position, an entirety of the second seal member is disposed in the channel of the first seal member, and while the second seal member is in the second position, a sealing end portion of the second seal member is located circumferentially outside of the channel of the first seal member while a remaining portion of the second seal member is disposed in the channel of the first seal member.

15. The seal assembly of claim 10, wherein the at least one intermediate position is selected based on a desired amount of leakage permitted through the leakage gap between the outlet portions of the first and second transition ducts.

16. A seal system in a gas turbine engine including an annular array of transition ducts that provide hot working gases from a combustion section to a turbine section of the engine, the transition ducts including outlet portions, the seal system comprising:

a corresponding seal assembly associated with each respective transition duct outlet portion, each seal assembly comprising:

a first seal member affixed to the outlet portion of the respective transition duct; and a second seal member associated with the first seal member and movable with respect to the first seal member, the second seal member positionable in at least a non-sealing first position with respect to the outlet portion of an adjacent transition duct and a sealing second position with respect to the outlet portion of the adjacent transition duct;

wherein, while in the first position, the second seal member of each seal assembly is circumferentially spaced from the outlet portion of the adjacent transition duct; and wherein, while in the second position, the second seal member of each seal assembly extends across a circumferential leakage gap between adjacent transition duct outlet portions and creates a seal with the outlet portion of the adjacent transition duct to substantially prevent leakage through the leakage gap.

17. The seal system of claim 16, wherein:

the first seal member of each seal assembly defines a circumferentially extending channel that receives the corresponding second seal member such that the first and second seal members of each seal assembly are nested together, wherein the second seal member moves within the channel when moving between the first and second positions.

18. The seal system of claim 16, wherein the first seal member of each seal assembly includes an aft face that contacts a turbine section inlet structure to substantially prevent leakage between each transition duct and the turbine section inlet structure.

19. The seal system of claim 16, wherein the second seal member of each seal assembly defines a circumferentially extending channel that receives affixation structure that is used to retain the respective second seal member in a selected position, the affixation structure also being used to secure the first seal member of each seal assembly to the outlet portion of the corresponding transition duct.

20. The seal system of claim 16, wherein the second seal member of each seal assembly is movable to at least one intermediate position between the first position and the second position, and wherein the at least one intermediate position is selected based on a desired amount of leakage permitted through the leakage gap between the outlet portions of the respective transition ducts.

* * * * *